US007703952B2

(12) United States Patent
Yoon

(10) Patent No.: US 7,703,952 B2
(45) Date of Patent: Apr. 27, 2010

(54) LAMP SUPPORT

(75) Inventor: Sang-Yeon Yoon, Busan (KR)

(73) Assignee: AITEC Co., Ltd., Busan (KR)

( * ) Notice: Subject to any disclaimer, the term of this patent is extended or adjusted under 35 U.S.C. 154(b) by 417 days.

(21) Appl. No.: 11/892,741

(22) Filed: Aug. 27, 2007

(65) Prior Publication Data

US 2009/0059607 A1 Mar. 5, 2009

(51) Int. Cl.
*F21L 4/04* (2006.01)

(52) U.S. Cl. ..... 362/396; 362/103; 362/419; 362/427; 362/191

(58) Field of Classification Search ..... 362/396, 362/419, 427, 103, 105, 106, 191; 248/316.7, 248/231.81, 292.12, 289.11, 297.31
See application file for complete search history.

(56) References Cited

U.S. PATENT DOCUMENTS 5,255,168 A * 10/1993 Stevens ..... 362/108
6,619,813 B1 * 9/2003 Schnell ..... 362/116
6,764,194 B1 * 7/2004 Cooper ..... 362/105

* cited by examiner

*Primary Examiner*—Sharon E Payne
(74) *Attorney, Agent, or Firm*—Harness, Dickey & Pierce, P.L.C.

(57) ABSTRACT

A lamp support includes a clamp, a ratchet member, a lamp housing and a latch member. The clamp is capable of being attached to a human body. The clamp has a circular receiving groove. A plurality of ratchet grooves is formed at a bottom face of the receiving groove along a first rotation direction. The ratchet member is rotatably received in the receiving groove along the first rotation direction. The ratchet member has a ratchet projection selectively inserted into the ratchet grooves. The lamp housing is rotatably connected to the ratchet member along a second rotation direction substantially perpendicular to the first rotation direction. The lamp housing has an inner space for receiving a lamp. The lamp housing has a plurality of latch grooves arranged along the second rotation direction. The latch member is fixed to the ratchet member. The latch member is selectively inserted into the latch grooves.

20 Claims, 9 Drawing Sheets

LAMP SUPPORT

BACKGROUND OF THE INVENTION

1. Field of the Invention

Example embodiments of the present invention relate to a lamp support. More particularly, example embodiments of the present invention relate to a lamp support capable of being attached to a human body.

2. Description of the Related Art

Generally, a user may grasp a lamp with one hand to illuminate a desired place. However, since the hand used to grasp the lamp cannot be used for other uses, there exist many inconveniences related to the lamp.

To overcome the above-mentioned inconveniences, a lamp support capable of being attached to the human body of the user, for example, the head of the user, is proposed. In the lamp support, a light-irradiation angle of the lamp may be determined in accordance with a direction in which the head is pointed. Thus, it may be difficult to illuminate the desired place. Therefore, a mechanism for changing the light-irradiation angle of the lamp and for maintaining a set light-irradiation angle of the lamp without altering the posture of the user may be provided to the lamp support.

However, in a conventional lamp support, the light-irradiation angle of the lamp may be changed along only one rotation direction. For example, the light-irradiation angle of the lamp may be changed along only a rotation direction from the head to the feet of the user. Therefore, the light-irradiation angle of the lamp may be changed along upward and downward directions without moving the head of the user. In contrast, it may be impossible to change the light-irradiation angle of the lamp along left and right directions without moving the head of the user. As a result, to change the light-irradiation angle of the lamp along the left and right directions, it may be required to move the head of the user along the left and right directions.

SUMMARY OF THE INVENTION

Example embodiments of the present invention provide a lamp support that is capable of readily changing a light-irradiation angle of a lamp along two rotation directions without moving the posture of a user.

A lamp support in accordance with one aspect of the present invention includes a clamp, a ratchet member, a lamp housing and a latch member. The clamp is capable of being attached to a human body. Further, the clamp has a circular receiving groove. A plurality of ratchet grooves is formed at a bottom face of the receiving groove along a first rotation direction. The ratchet member is rotatably received in the receiving groove along the first rotation direction. Further, the ratchet member has a ratchet projection selectively inserted into the ratchet grooves. The lamp housing is rotatably connected to the ratchet member along a second rotation direction substantially perpendicular to the first rotation direction. The lamp housing has an inner space for receiving a lamp. Further, the lamp housing has a plurality of latch grooves arranged along the second rotation direction. The latch member is fixed to the ratchet member. Further, the latch member is selectively inserted into the latch grooves.

According to one example embodiment, the clamp may include a base having the receiving groove, a clip rotatably connected to the base, and a coil spring for resiliently support the clip toward the base. Further, the ratchet grooves may be formed at the bottom face of the receiving groove along a circumferential direction of the receiving groove. The base may have a fixing groove formed in the receiving groove. The fixing groove may have a holding groove. The ratchet member may have a fixing portion rotatably received in the fixing groove along the first rotation direction. The fixing portion may have a holding portion inserted into the holding groove. Additionally, a buffer pad may be attached to a lower face of the clip. The clip may have a plurality of clamping holes. Rings may be connected to the clamping holes. A flexible band for surrounding a circular structure, which is capable of being attached to the human body, may be connected to the rings.

According to another example embodiment, the ratchet member may include a circular plate and a bracket. The circular plate may have the ratchet projection. Further, the circular plate may be received in the receiving groove along the first rotation direction. The bracket may be formed on the circular plate. The lamp housing may be rotatably connected to the bracket along the second rotation direction. The latch member may be secured to the bracket. Further, the ratchet projection may have two projections opposite to each other with respect to the center of the circular plate. A pair of slots may be formed at the circular plate along both sides of the ratchet projection.

According to still another example embodiment, the lamp housing may include a lower cover and an upper cover. The lower cover may be rotatably connected to the ratchet member. Further, the lower cover may include a hinged portion rotatably connected to the ratchet member. The hinged portion may have the latch grooves. The upper cover may be assembled with the lower cover to form a space in which the lamp is received. Here, the lamp may be protruded from a side face of the upper cover and the lower cover. Further, the lamp housing may additionally include a battery holder interposed between the upper cover and the lower cover to receive a battery for supplying a current to the lamp. Additionally, a pair of grasping grooves may be formed at both sides of the upper cover and the lower cover.

A lamp support in accordance with another aspect of the present invention includes a clamp, a ratchet member and a lamp housing. The clamp is capable of being attached to a human body. Further, the clamp has a circular receiving groove. A plurality of first ratchet grooves is formed at a bottom face of the receiving groove along a first rotation direction. The ratchet member is rotatably received in the receiving groove along the first rotation direction. Further, the ratchet member has a first ratchet projection selectively inserted into the first ratchet grooves, and second ratchet grooves arranged along a second rotation direction substantially perpendicular to the first rotation direction. The lamp housing is rotatably connected to the ratchet member along the second rotation direction. The lamp housing has an inner space for receiving a lamp. Further, the lamp housing has a plurality of second ratchet projections selectively inserted into the second ratchet grooves.

According to another example embodiment, the ratchet member may include a circular plate and a bracket. The circular plate may have the first ratchet projection. Further, the circular plate may be received in the receiving groove along the first rotation direction. The bracket may be formed on the circular plate. The lamp housing may be rotatably connected to the bracket along the second rotation direction. The second ratchet grooves may be formed at inner faces of the bracket.

According to still another example embodiment, the lamp housing may include a lamp holder and a cover. The lamp holder may be rotatably connected to the ratchet member. Further, the lamp holder may include a hinged portion rotatably connected to the ratchet member. The hinged portion may have the second ratchet projection. The cover may be assembled with the lamp holder to emit light from the lamp.

According to the present invention, the ratchet member may be rotatably connected to the clamp along the first rotation direction. Further, the lamp housing may be rotatably connected to the ratchet member along the second rotation directions. Thus, the lamp housing may be readily rotated along the first rotation direction and the second rotation direction so that a light-irradiation direction of the lamp may be readily changed along desired directions. Further, since the ratchet projection may be selectively inserted into the ratchet grooves, the lamp housing may be firmly fixed at a desired position.

BRIEF DESCRIPTION OF THE DRAWINGS

The above and other features and advantages of the invention will become readily apparent by reference to the following detailed description when considered in conjunction with the accompanying drawings wherein.

DESCRIPTION OF THE EMBODIMENTS

Figure 1:
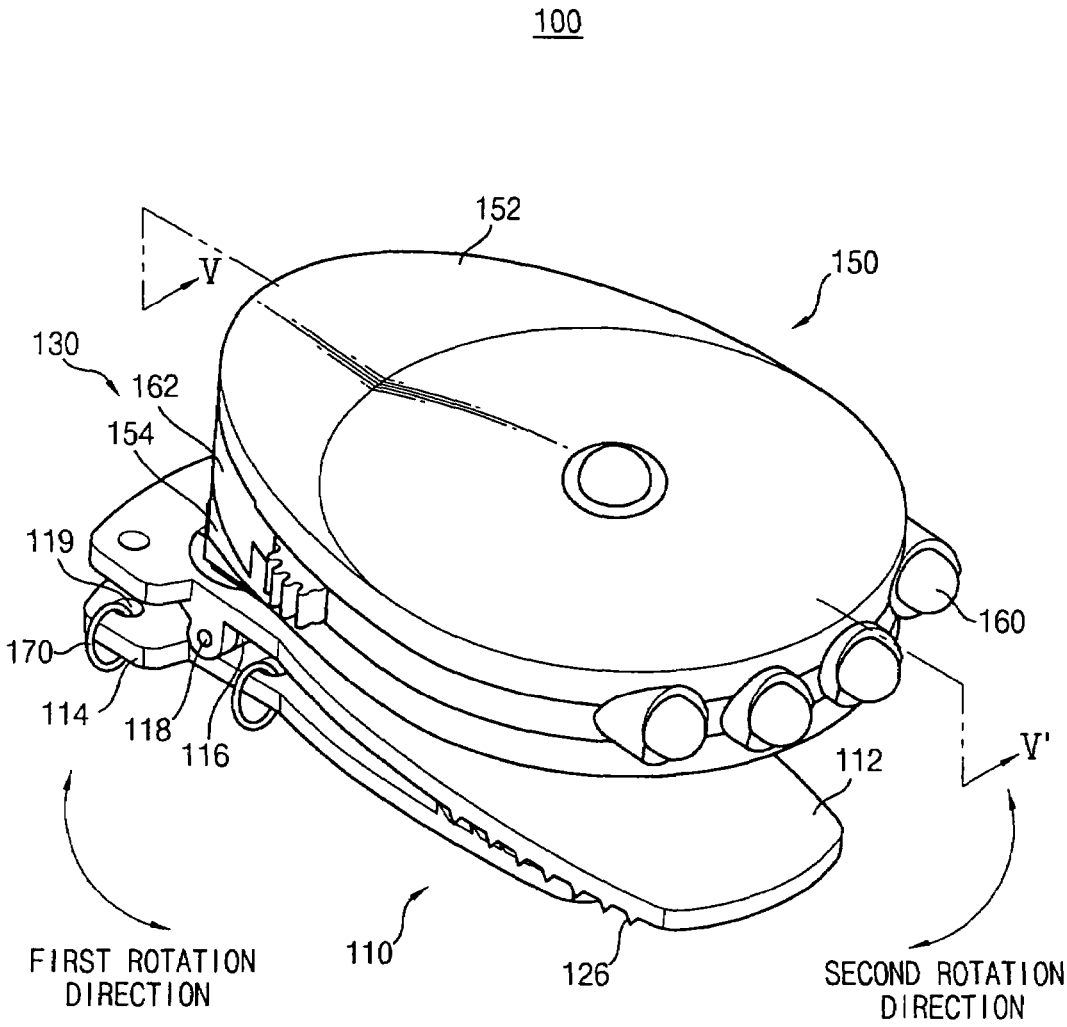
FIG. 1 is a perspective view illustrating a lamp support in accordance with a first example embodiment of the present invention.

The present invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiment 1

Figure 2:
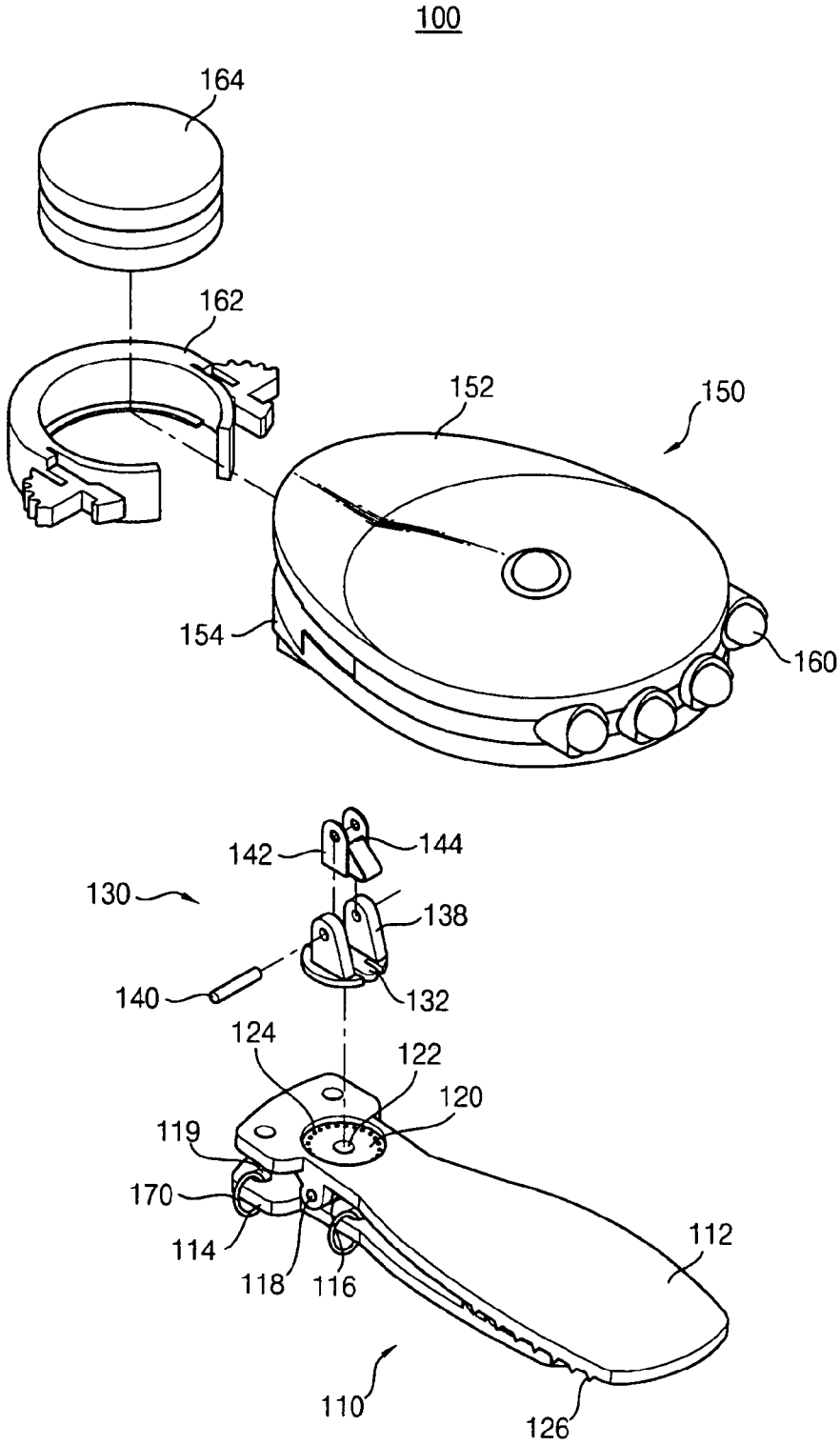
FIG. 2 is an exploded perspective view illustrating the lamp support in FIG. 1.
Figure 3:
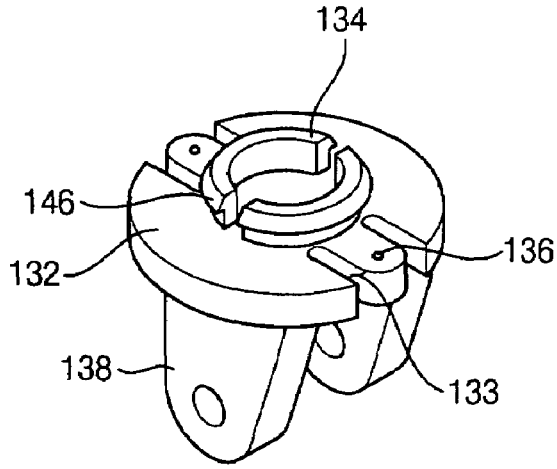
FIG. 3 is a perspective view illustrating the bottom face of the ratchet member in the lamp support of FIG. 1.
Figure 4:
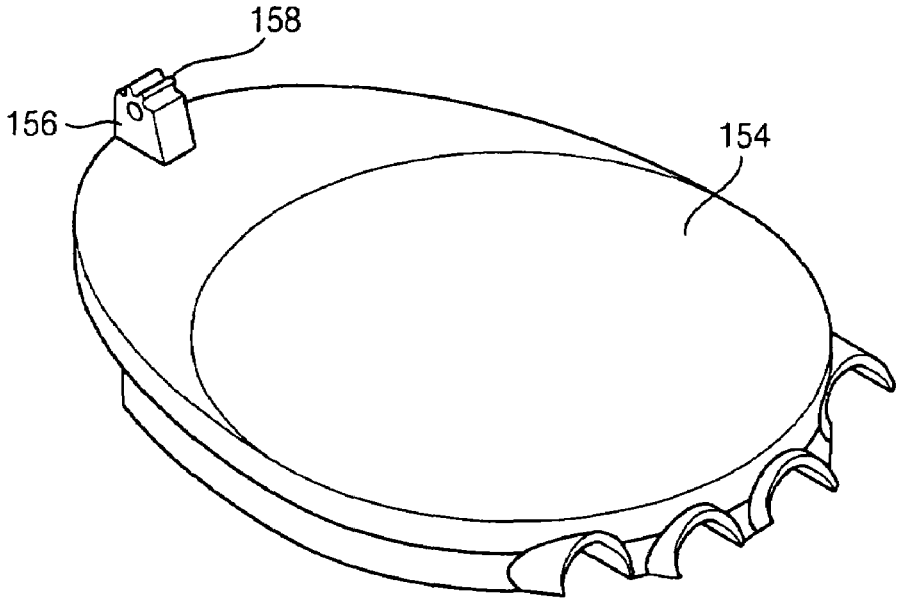
FIG. 4 is a perspective view illustrating the bottom face of the lower cover member in the lamp support of FIG. 1.
Figure 5:
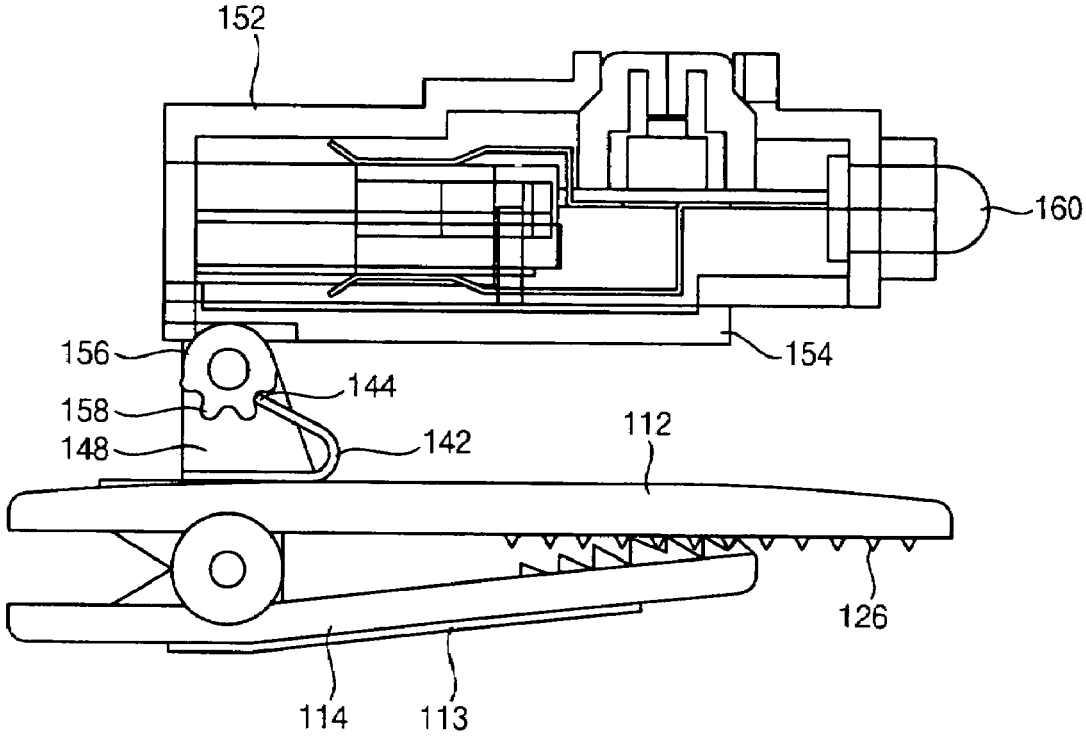
FIG. 5 is a cross-sectional view taken along a line V-V' in FIG. 1.

FIG. 1 is a perspective view illustrating a lamp support in accordance with a first example embodiment of the present invention, FIG. 2 is an exploded perspective view illustrating the lamp support in FIG. 1, FIG. 3 is a perspective view illustrating the bottom face of the ratchet member in the lamp support of FIG. 1, FIG. 4 is a perspective view illustrating the bottom face of the lower cover member in the lamp support of FIG. 1, and FIG. 5 is a cross-sectional view taken along a line V-V' in FIG. 1.

Referring to FIGS. 1 to 5, a lamp support 100 of this example embodiment includes a clamp 110, a ratchet member 130, a latch member 142 and a lamp housing 150.

The clamp 110 is capable of being detachably attached to the body of a user, for example, the head of the user. The clamp 110 includes a base 112, a clip 114 rotatably connected to a lower face of the base 112, and a coil spring 116 for resiliently supporting the clip 114 toward the base 112.

Additionally, when the clip 114 directly makes contact with the head or a wrist of the user, a buffer pad 113 may be attached to a lower face of the clip 114. The buffer pad 113 is interposed between the clip 114 and the body of the user to reduce some of the pressure from the clip 114 to the body of the user.

Further, a plurality of clamping holes 119 may be formed through both side portions of the clip 114. Rings 170 may be inserted into the clamping holes 119, respectively. A flexible band (not shown) for surrounding a circular pipe, which may be attached to the body of the user, may be connected to the rings 170. That is, the clamping holes 119 may be used for securing the lamp support 100 to a circular structure such as a pipe.

A circular receiving groove 120 is formed at a surface portion of the base 112. Further, a circular fixing groove 122 is formed in the receiving groove 120. Here, the fixing groove 122 has a diameter shorter than that of the receiving groove 120. A holding groove may be formed along an edge portion of the fixing groove 122. The receiving groove 120 and the fixing groove 122 have a concentric center point. Thus, the receiving groove 120 and the fixing groove 122 are arranged in a concentric circle pattern. The ratchet member 130 is rotatably received in the fixing groove 122 and the receiving groove 120.

Ratchet grooves 124 are formed at a bottom face of the receiving groove 120 along a first rotation direction. In this example embodiment, the ratchet grooves 124 may be arranged at the bottom face of the receiving groove 120 along a circumferential direction of the receiving groove 120. Further, the ratchet grooves 124 may be arranged at substantially the same interval.

The clip 114 is rotatably connected to a lower face of the base 112 using a hinge pin 118. The coil spring 116 is wound on the hinge pin 118 to resiliently support the clip 114 toward the base 112. After the user presses the clip 114 to widen a gap between the clip 114 and the base 112, a band worn on the head of the user may be inserted into the gap between the clip 114 and the base 112. When an external force applied to the clip 114 is removed, the clip 114 is rotated toward the base 112 by the coil spring 116. Thus, the band interposed between the clip 114 and the base 112 may be firmly fixed. Additionally, protruded portions 126 may be provided to the clip 114 and the base 112 so that the clip 114 may be firmly secured to the base 112.

The ratchet member 130 is rotatably connected to the clamp 110 along the first rotation direction. The ratchet member 130 includes a circular plate 132 and a bracket 138.

The circular plate 132 is rotatably received in the receiving groove 120 along the first rotation direction. Therefore, the circular plate 132 may have an area corresponding to that of the receiving groove 120. In this example embodiment, when friction is generated between an outer face of the circular plate 132 and an inner face of the receiving groove 120 during rotation of the circular plate 132, the circular plate 132 may not be smoothly rotated. Thus, the area of the circular plate 132 may be slightly smaller than that of the receiving groove 120.

A ratchet projection 136 is formed at a lower face of the circular plate 132. The ratchet projection 136 is selectively inserted into the ratchet grooves 124. Here, when a rotation force is applied to the ratchet projection 136, the ratchet projection 136 is released from the ratchet grooves 124. During the above-mentioned releasing operation, the ratchet projection 136 may be slightly elastically deformed. Thus, the ratchet projection 136 may include an elastic material. As a result, the ratchet projection 136 may be rotated 360° along the first rotation direction. Further, the ratchet projection 136 is selectively inserted into the ratchet grooves 124 so that the ratchet projection 136 is fixed at any one position. In this example embodiment, the ratchet projection 136 may have two projections opposite to each other with respect to the center point of the circular plate 132.

Additionally, to allow easy release of the ratchet projection 136 from the ratchet grooves 124, a pair of slots 133 may be formed at the circular plate 132 along both sides of the ratchet projections 136. Thus, a portion of the circular plate 132 in which the ratchet projections 136 are positioned is spaced apart from the remaining portions of the circular plate 132 in which the ratchet projections 136 are not positioned due to the slots 133. As a result, when the circular plate 132 is rotated, the portion of the circular plate 132 in which the ratchet projections 136 are positioned may be slightly rotated in the slots 133 so that the ratchet projections 136 may be readily released from the ratchet grooves 124.

A fixing portion 134 is formed at the lower face of the circular plate 132. The fixing portion 134 and the circular plate 132 have a concentric center point. The fixing portion 134 is rotatably received in the fixing groove 122 along the first rotation direction. A holding projection 146 is formed along an outer face of the fixing portion 134. The holding projection 146 is inserted into the holding groove to prevent the circular plate 132 from being released from the receiving groove 120.

The bracket 138 is formed on the upper face of the circular plate 132. The lamp housing 150 is rotatably connected to the bracket 138 along a second rotation direction substantially perpendicular to the first rotation direction. In this example embodiment, the lamp housing 150 is rotatably connected to the bracket 138 using a hinge pin 140.

The latch member 142 is fixed to the bracket 138 using the hinge pin 140. The latch member 142 has a latch arranged toward the lamp housing 150. In this example embodiment, the latch member 142 may include a leaf spring.

The lamp housing 150 is rotatably connected to the bracket 138 along the second rotation direction. The lamp housing 150 includes an upper cover 152, a lower cover 154 and a battery holder 162.

The upper cover 152 and the lower cover 154 have an elliptical plate shape. Thus, when the upper cover 152 and the lower cover 154 are assembled with each other, an elliptical structure having an inner space for receiving the lamp 160 is formed. The lamp 160 is protruded from a side face of the assembled upper and lower covers 152 and 154.

A hinged portion 156 is formed at a lower face of the lower cover 154. The hinged portion 156 is rotatably connected to the bracket 138 using the hinge pin 140 along the second rotation direction. Latch grooves 158 are formed along an outer face of the hinged portion 156. The latch grooves 158 are arranged along the second rotation direction so that the latch 144 of the latch member 142 is selectively inserted into the latch grooves 158. Thus, the lamp housing 150 may be readily rotated along the second rotation direction. Further, since the latch member 142 is selectively inserted into the latch grooves 158, the lamp housing 150 may be firmly fixed at any one position.

The battery holder 162 receives a battery 165 for supplying a current to the lamp 160. The battery holder 162 is interposed between the upper cover 152 and the lower cover 154.

According to this example embodiment, the ratchet member may be rotatably connected to the clamp along the first rotation direction and firmly fixed at any one position. Further, the lamp housing may be rotatably connected to the ratchet member along the second rotation direction and firmly fixed at any one position. As a result, the light-irradiation angle of the lamp may be readily changed without moving the body of the user.

Embodiment 2

Figure 6:
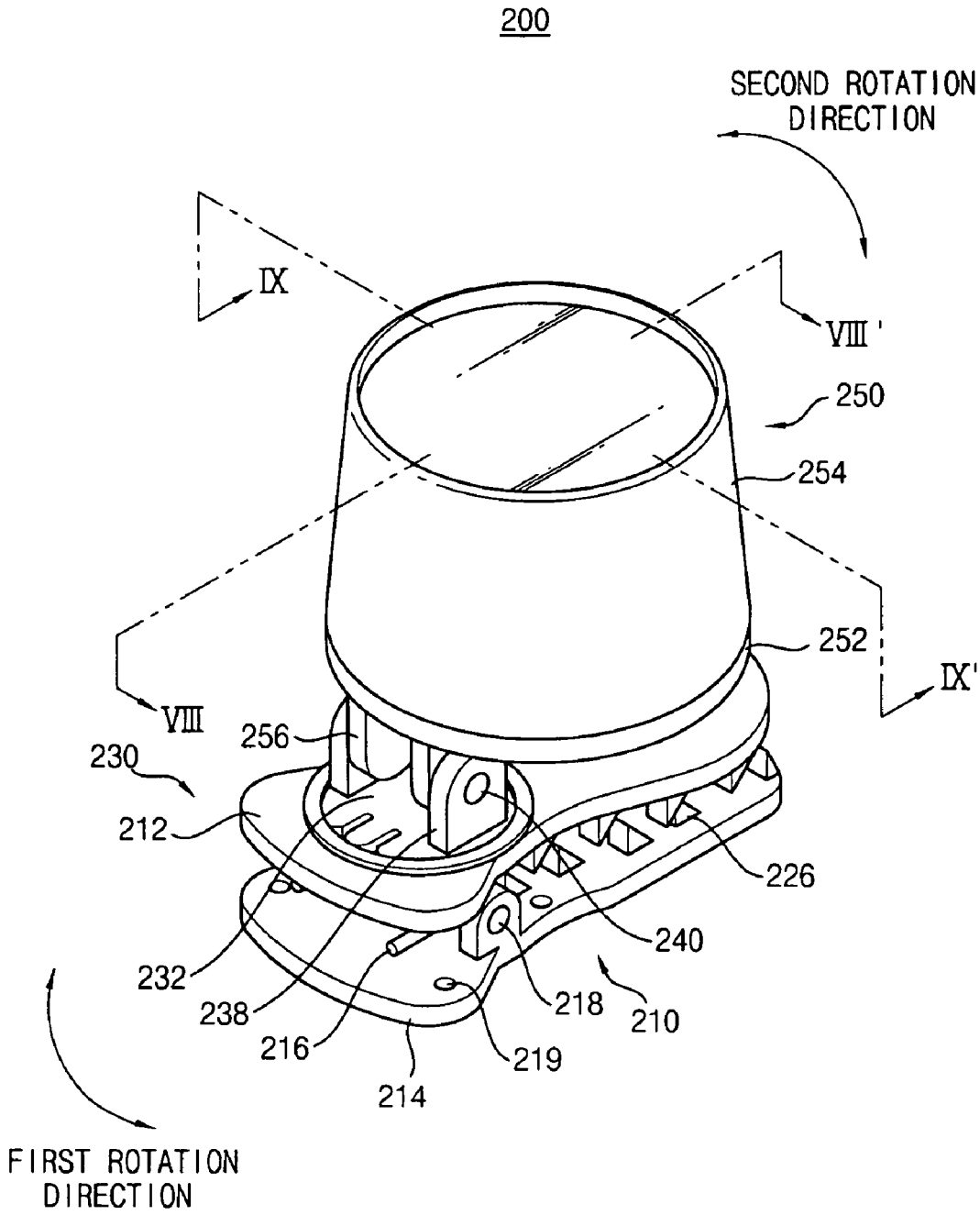
FIG. 6 is a perspective view illustrating a lamp support in accordance with a second example embodiment of the present invention.
Figure 7:
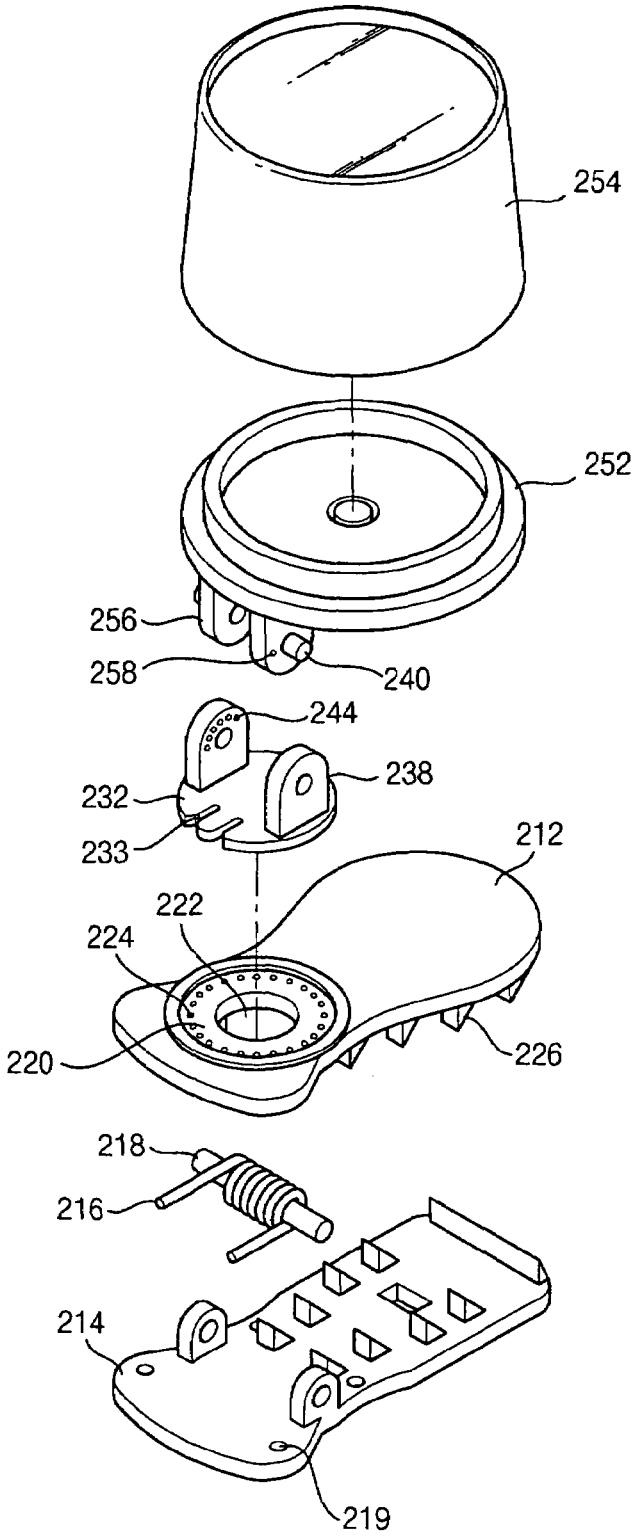
FIG. 7 is an exploded perspective view illustrating the lamp support in FIG. 6.
Figure 8:
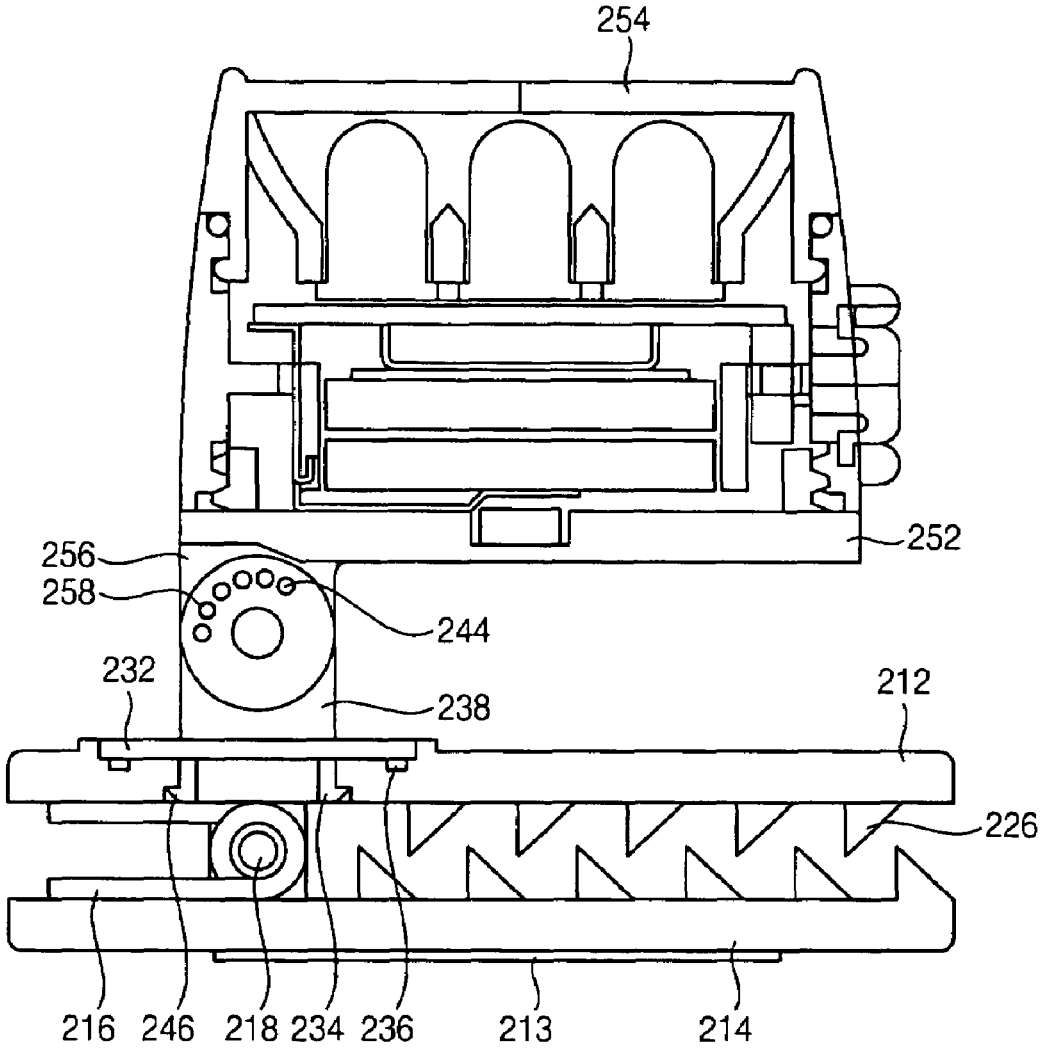
FIG. 8 is a cross-sectional view taken along a line VIII-VIII' in FIG. 6.
Figure 9:
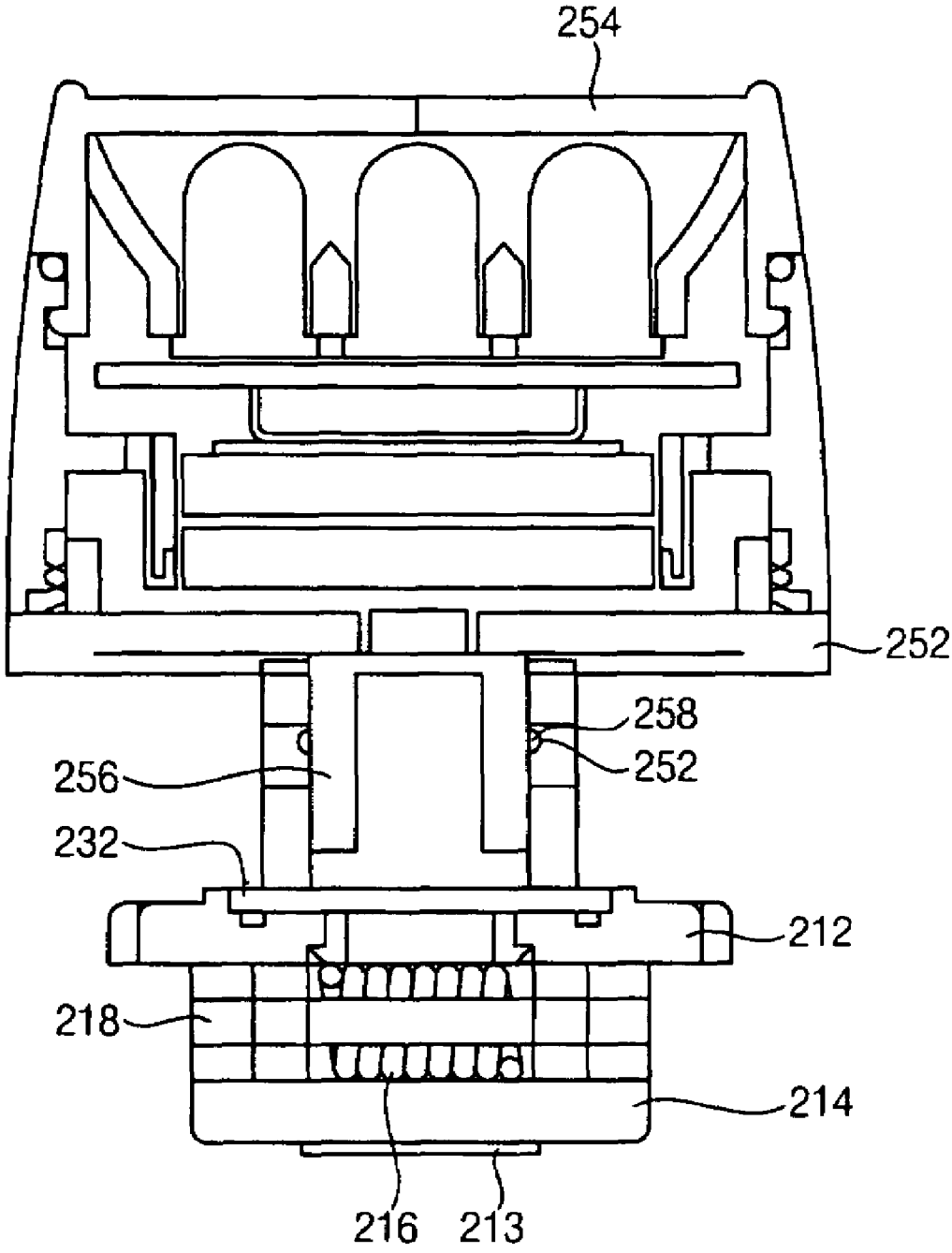
FIG. 9 is a cross-sectional view taken along a line IX-IX' in FIG. 6.

FIG. 6 is a perspective view illustrating a lamp support in accordance with a second example embodiment of the present invention, FIG. 7 is an exploded perspective view illustrating the lamp support in FIG. 6, FIG. 8 is a cross-sectional view taken along a line VIII-VIII' in FIG. 6, and FIG. 9 is a cross-sectional view taken along a line IX-IX' in FIG. 6.

Referring to FIGS. 6 to 9, a lamp support 200 of this example embodiment includes a clamp 210, a ratchet member 230 and a lamp housing 250.

The clamp 210 includes a base 212, a clip 214 rotatably connected to a lower face of the base 212, and a coil spring 216 for resiliently supporting the clip 214 toward the base 212. Additionally, a buffer pad 213 may be attached to a lower face of the clip 214. Further, a plurality of clamping holes 219 may be formed through both side portions of the clip 214. Rings (not shown) may be inserted into the clamping holes 219, respectively.

A circular receiving groove 220 is formed at a surface portion of the base 212. Further, a circular fixing groove 222 is formed in the receiving groove 220. First ratchet grooves 224 are formed at a bottom face of the receiving groove 220 along a first rotation direction. A holding groove may be formed along an edge portion of the fixing groove 222. The clip 214 is rotatably connected to a lower face of the base 212 using a hinge pin 218. The coil spring 216 is wound on the hinge pin 218 to resiliently support the clip 214 toward the base 212. Additionally, protruded portions 226 may be provided to the clip 214 and the base 212.

The ratchet member 230 includes a circular plate 232 and a bracket 238. The circular plate 232 is rotatably received in the receiving groove 220 along the first rotation direction. Two first ratchet projections 236 are formed at a lower face of the circular plate 232. Additionally, to allow easy release of the first ratchet projections 236 from the first ratchet grooves 224, a pair of slots 233 may be formed at the circular plate 232 along both sides of the ratchet projections 236. A fixing portion 234 is formed at the lower face of the circular plate 232. The fixing portion 234 is rotatably received in the fixing groove 222 along the first rotation direction. A holding projection 246 is formed along an outer face of the fixing portion 234. The holding projection is inserted into the holding groove.

The bracket 238 is formed on the upper face of the circular plate 232. The lamp housing 250 is rotatably connected to the bracket 238 along a second rotation direction substantially perpendicular to the first rotation direction. Second ratchet grooves 244 are formed at inner faces of the bracket 238 along the second rotation direction.

The lamp housing 250 is rotatably connected to the bracket 238 along the second rotation direction. The lamp housing 250 includes a lamp holder 252 and a cover 254. The cover 254 is assembled with the lamp holder 252 to emit light emitted from a lamp (not shown). In this example embodiment, the cover 254 may have a cylindrical shape.

The lamp is received in the lamp holder 252. The lamp is fixed to a bottom face of the lamp holder 252. In this example embodiment, the lamp holder 252 may have a circular plate shape.

A hinged portion 256 is formed at a lower face of the lamp holder 252. A hinge pin 240 is integrally formed with the hinged portion 256. Thus, the hinged portion 256 is rotatably connected to the bracket 238 using the hinge pin 240 along the second rotation direction. Second ratchet grooves 258 are formed along both outer faces of the hinged portion 256. The second ratchet projections 244 are selectively inserted into the second ratchet grooves 258.

According to this example embodiment, the second ratchet grooves may be integrally formed with the bracket without the latch in Embodiment 1. Thus, costs for manufacturing the lamp support may be curtailed owing to a fewer number of parts in the lamp support.

Embodiment 3

Figure 10:
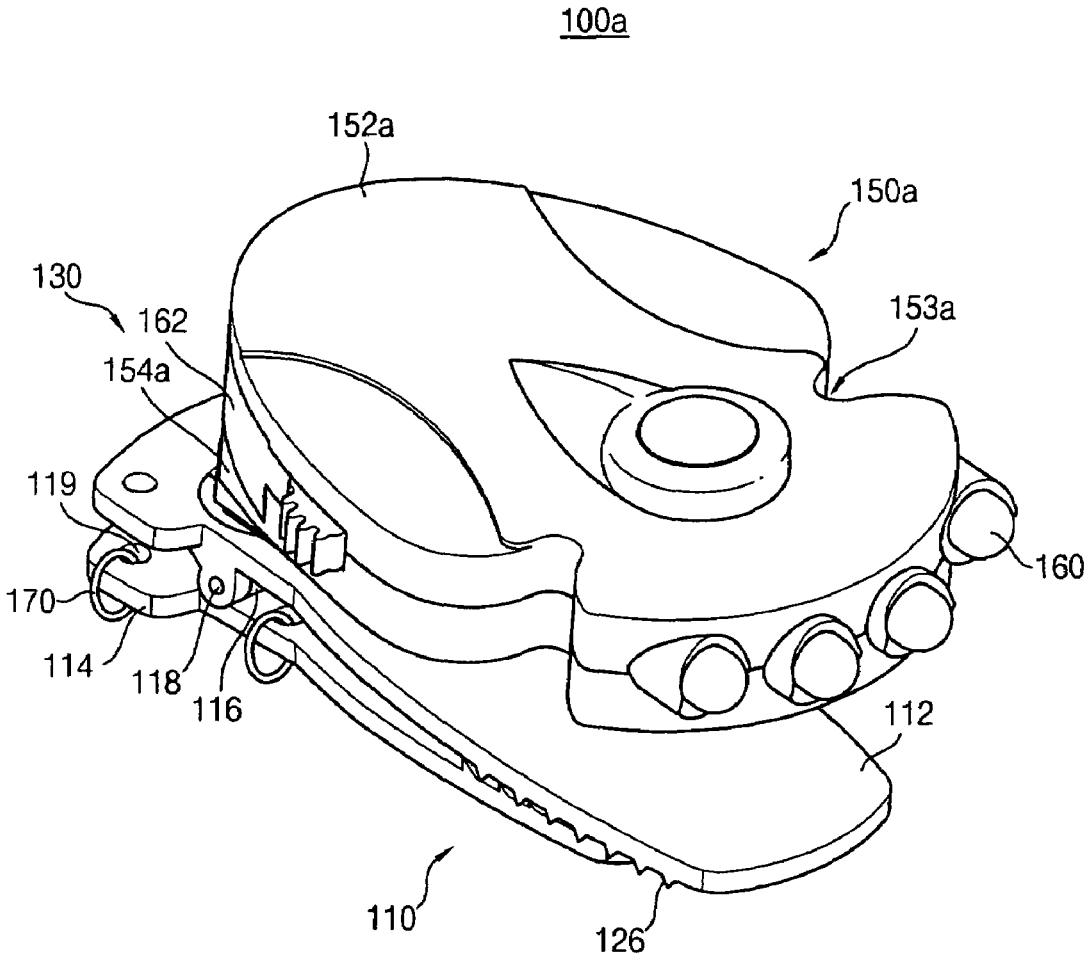
FIG. 10 is a perspective view illustrating a lamp support in accordance with a third example embodiment of the present invention.

FIG. 10 is a perspective view illustrating a lamp support in accordance with a third example embodiment of the present invention.

A lamp support 100*a* of this example embodiment includes elements substantially the same as those in the lamp support 100 of Embodiment 1 except for a shape of a lamp housing. Thus, the same reference numerals refer to the same elements and any further illustrations with respect to the same elements are omitted herein for brevity.

Referring to FIG. 10, the lamp housing 150*a* of the lamp support 100*a* in accordance with this example embodiment includes an upper cover 152*a*, a lower cover 154*a* and a battery holder 162. The upper cover 152*a* and the lower cover 154*a* are assembled with each other to form an elliptical plate shape. In this example embodiment, in order to allow a hand of a user to readily grasp the lamp housing 150*a*, a pair of grasping grooves 153*a* is formed at both side edges of the upper cover 152*a* and the lower cover 154*a*.

According to the present invention, a lamp housing may be readily rotated along a first rotation direction and a second rotation direction. Therefore, a light-irradiation angle of a lamp may be changed toward desired directions without changing the posture of a user.

Having described the preferred embodiments of the present invention, it is noted that modifications and variations can be made by persons skilled in the art in light of the above teachings. It is therefore to be understood that changes may be made in the particular embodiment of the present invention disclosed which is within the scope and the spirit of the invention outlined by the appended claims.

What is claimed is:

1. A lamp support comprising:

a clamp capable of being attached to the body of a user, the clamp having a circular receiving groove and ratchet grooves that are formed at a bottom face of the receiving groove along a first rotation direction;

a ratchet member rotatably received in the receiving groove along the first rotation direction, the ratchet member having a ratchet projection that is selectively inserted into the ratchet grooves;

a lamp housing rotatably connected to the ratchet member along a second rotation direction substantially perpendicular to the first rotation direction, the lamp housing having an inner spacer for receiving a lamp and a plurality of latch grooves that are formed along the second rotation direction; and a latch member fixed to the ratchet member and selectively inserted into the latch grooves.

2. The lamp support of claim 1, wherein the clamp comprises:

a base having the receiving groove;

a clip rotatably connected to the base; and a coil spring for resiliently supporting the clip toward the base.

3. The lamp support of claim 2, wherein the clamp further comprises a buffer pad attached to a lower face of the clip.

4. The lamp support of claim 2, wherein the clip has a plurality of clamping holes, and a flexible band for surrounding a circular structure, which is capable of being attached to the body of the user, is connected to the clamping holes.

5. The lamp support of claim 1, wherein the ratchet grooves are arranged at the bottom face of the receiving groove along a circumferential direction of the receiving groove.

6. The lamp support of claim 1, wherein the clamp has a fixing groove formed in the receiving groove, the fixing groove has a holding groove, the ratchet member has a fixing portion rotatably received in the fixing groove along the first rotation direction, and the fixing portion has a holding projection inserted into the holding groove.

7. The lamp support of claim 1, wherein the ratchet member comprises:

a circular plate having the ratchet projection, the circular plate rotatably received in the receiving groove along the first rotation direction; and a bracket formed on the circular plate, the lamp housing rotatably connected to the bracket along the second rotation direction, and the latch member fixed to the bracket.

8. The lamp support of claim 7, wherein the ratchet projection has two projections opposite to each other with respect to the center of the circular plate.

9. The lamp support of claim 7, wherein the circular plate has a pair of slots formed along both sides of the ratchet projection.

10. The lamp support of claim 1, wherein the lamp housing comprises:

a lower cover having a hinged portion that is rotatably connected to the ratchet member and the has latch grooves; and an upper cover assembled with the lower cover to form the inner space for receiving the lamp, wherein the lamp is protruded from side faces of the upper cover and the lower cover.

11. The lamp support of claim 10, wherein the lamp housing further comprises a battery holder interposed between the upper cover and the lower cover to receive a battery for supplying a current to the lamp.

12. The lamp support of claim 10, wherein a pair of grasping grooves for receiving a hand of the user is formed at both sides of the upper cover and the lower cover.

13. The lamp support of claim 1, wherein the latch member comprises a leaf spring.

14. A lamp support comprising:

a clamp attached to the body of a user, the clamp having a circular receiving groove and first ratchet grooves that are formed at a bottom face of the receiving groove along a first rotation direction;

a ratchet member rotatably received in the receiving groove along the first rotation direction, the ratchet member having a first ratchet projection that is selectively inserted into the first ratchet grooves, and second ratchet grooves that are arranged along a second rotation direction substantially perpendicular to the first rotation direction; and a lamp housing rotatably connected to the ratchet member along the second rotation direction, the lamp housing having an inner spacer for receiving a lamp and a second ratchet projection that is selectively inserted into the second ratchet grooves.

15. The lamp support of claim 14, wherein the clamp comprises:

a base having the receiving groove;

a clip rotatably connected to the base; and a coil spring for resiliently supporting the clip toward the base.

16. The lamp support of claim 14, wherein the first ratchet grooves are arranged at the bottom face of the receiving groove along a circumferential direction of the receiving groove.

17. The lamp support of claim 14, wherein the clamp has a fixing groove formed in the receiving groove, the fixing groove has a holding groove, the ratchet member has a fixing portion rotatably received in the fixing groove along the first rotation direction, and the fixing portion has a holding projection inserted into the holding groove.

18. The lamp support of claim 14, wherein the ratchet member comprises:

a circular plate having the first ratchet projection, the circular plate rotatably received in the receiving groove along the first rotation direction; and a bracket formed on the circular plate, the lamp housing rotatably connected to the bracket along the second rotation direction, and the bracket having the second ratchet grooves that are formed along inner faces of the bracket.

19. The lamp support of claim 18, wherein the circular plate has a pair of slots formed along both sides of the first ratchet projection.

20. The lamp support of claim 14, wherein the lamp housing comprises:

a lamp holder having a hinged portion that is rotatably connected to the ratchet member and has the second ratchet projection to receive the lamp; and a cover assembled with the lamp holder to emit light emitted from the lamp.

* * * * *